United States Patent [19]

Tokita et al.

[11] Patent Number: 4,866,333

[45] Date of Patent: Sep. 12, 1989

[54] COLOR PICTURE TUBE WITH SHADOW MASK SUPPORTING ASSEMBLY

[75] Inventors: Kiyoshi Tokita, Fukaya; Toshinao Sone, Kumagaya; Hiroshi Urata, Fukaya; Michio Nakamura, Saitama, all of Japan

[73] Assignee: Kabushiki Kaisha Toshiba, Kawasaki, Japan

[21] Appl. No.: 186,742

[22] Filed: Apr. 25, 1988

Related U.S. Application Data

[63] Continuation of Ser. No. 911,061, Sep. 24, 1986, abandoned.

[30] Foreign Application Priority Data

Sep. 25, 1985 [JP] Japan ..... 60-210144
Oct. 17, 1985 [JP] Japan ..... 60-229811

[51] Int. Cl.[4] ..... H01J 29/81
[52] U.S. Cl. ..... 313/406; 313/404
[58] Field of Search ..... 313/402, 404, 406

[56] References Cited

U.S. PATENT DOCUMENTS

| | | | |
|---|---|---|---|
| 2,951,167 | 8/1960 | Kegg et al. | 313/406 |
| 3,334,259 | 8/1967 | Shrader | 313/406 |
| 3,387,160 | 6/1968 | Schwartz | 313/406 |
| 3,553,517 | 1/1971 | DeBernardis | 313/406 |
| 3,610,990 | 10/1971 | Yamazaki | 313/404 |
| 3,873,875 | 3/1975 | Miller | 313/405 |
| 4,300,071 | 11/1981 | Dougherty et al. | 313/406 X |
| 4,387,321 | 6/1983 | Gijrath | 313/406 |
| 4,644,222 | 2/1987 | Brunn | 313/406 |
| 4,652,292 | 3/1987 | Tokita et al. | 313/404 |

FOREIGN PATENT DOCUMENTS

| | | |
|---|---|---|
| 0156362 | 2/1985 | European Pat. Off. . |
| 57-117547 | 7/1982 | Japan . |
| 60-67647 | 5/1985 | Japan . |

*Primary Examiner*—Donald J. Yusko
*Assistant Examiner*—Michael Horabik
*Attorney, Agent, or Firm*—Cushman, Darby & Cushman

[57] ABSTRACT

A color picture tube comprises a panel of a substantially rectangular shape, a phosphor screen formed on the inner surface of the panel, a stud pin which is made of a rod with a tapered portion and which is mounted on the inner side surface of the panel, a spring member having a through hole and fitted with the tapered portion of the stud pin through the through hole, and a shadow mask mounted on the panel through the stud pin and the spring member so as to be opposite or adjacent to the phosphor screen, wherein if the spring member is in contact with the stud pin at least two positions, the following inequality is satisfied:

$$N/F \leqq 1.8$$

where

N: a force of the spring member acting on that portion of the stud pin which contacts the spring member along a direction substantially perpendicular to the surface of the stud pin (kg.f)

F: a force of the spring member acting on that portion of the stud pin which contacts the spring member, along a direction substantially parallel to the central axis of the stud pin (kg.f).

6 Claims, 7 Drawing Sheets

COLOR PICTURE TUBE WITH SHADOW MASK SUPPORTING ASSEMBLY

This is a continuation of application Ser. No. 911,061 filed Sept. 24, 1986, which was abandoned upon the filing hereof.

BACKGROUND OF THE INVENTION

1. Field of the Invention

The present invention relates to a color picture tube and, more particularly, to a shadow mask supporting assembly.

2. Description of the Prior Art

In a conventional color picture tube, a shadow mask is mounted through spring members on stud pins embedded in the inner side wall surface of a panel of a rectangular shape. A phosphor screen is formed on the inner surface of the front side of the panel. Electron beams pass through predetermined apertures of the shadow mask and land at predetermined positions of the phosphor screen.

A typical conventional shadow mask supporting assembly in a color picture tube is illustrated in FIG. 1. The supporting assembly is a combination of stud pin 10 vertically extending on the inner side wall surface of panel 1 and spring member 13 having a through hole receiving pin 10. Pin 10 is tapered, and its tapering angle $\theta$ is normally about 12 degrees. In order to sufficiently compensate for mislanding of the electron beam on the phosphor screen caused by thermal expansion of shadow mask 7, movable part 13*a* forms an angle of about 55 degrees with respect to tube axis 14. By thermal expansion of the shadow mask, member 13 and mask frame 8 are moved to positions indicated by broken lines in FIG. 1. Mask 7 is slightly moved in the direction of screen 4 so that electron beam mislanding can be compensated.

In the supporting assembly for the shadow mask described above, when the color picture tube receives an impact or vibrations, member 13 is slid along pin 10 and is often fixed at a position different from the predetermined fitting position. In this case, the electron beam bombards a phosphor position different from the corresponding one degrading color purity. In the worst case, member 13 may be removed from pin 10.

In order to solve this problem, an elastic force of the spring member can be increased. However, in this case, the following problem is presented.

If a thermal expansion coefficient of a material constituting the stud pin is not substantially the same as that of the panel, cracks occur at that portion of the panel on which the stud pin is fixed, thus limiting the type of material which can be used for the stud pin. For example, a currently used material is exemplified by an Fe-Cr alloy (Cr: 18 wt%). This material is soft; it has a Vickers hardness (Hv) of 150. A typical spring member material is hard stainless steel having an Hv of 380 to 500. For this reason, if the spring force of the spring member is excessively large, or if an external impact is excessively large, the stud pin tends to be recessed. If the stud pin is recessed, the contact position of the spring member and the stud pin is shifted so that the position of the shadow mask is deviated to disable accurate landing of the electron beam on the phosphor screen.

Furthermore, since a large spring force is transmitted to the panel through the stud pin, the panel tends to be deformed. For this reason, the color picture tube is often damaged during normal annealing performed in the fabrication process of the color picture tube.

Furthermore, in the fabrication process of the color picture tube, the shadow mask must be repeatedly attached to or detached from the mask. If a large spring force acts on the panel, it is difficult to manually remove the shadow mask from the panel. Such detachment must be performed by a bulky detaching apparatus installed in the corresponding steps. In this case, a large pressure acts on the spring member, the mask frame, and the shadow mask (1) and thus may deform the mask frame or the shadow mask.

SUMMARY OF THE INVENTION

The present invention has been made in consideration of the above situation, and has as its object to provide a color picture tube suitable for mass production, wherein mislanding of electron beams can be sufficiently minimized from the initial operation of the picture tube for a long period of time to prevent color purity degradation such as color misregistration and to simplify detachment of a shadow mask, and an anti-impact property can be improved by a simple support member.

A color picture tube according to the present invention comprises a panel of a substantially rectangular shape, a phosphor screen formed on the inner side surface of the panel, a stud pin which is made of a rod with a tapered portion and which is mounted on the inner side surface of the panel, a spring member having a through hole and fitted with the tapered portion of the stud pin through the through hole, and a shadow mask mounted on the panel through the stud pin and the spring member so as to be opposite or adjacent to the phosphor screen. In the color picture tube, if the spring member is in contact with the stud pin at at least two positions, the following inequality is satisfied:

$$N/F \leqq 1.8$$

where

N: the force of the spring member acting on that portion of the stud pin which contacts the spring member, along a direction substantially perpendicular to the surface of the stud pin (kg.f)

F: the force of the spring member acting on that portion of the stud pin which contacts the spring member, along a direction substantially parallel to the central axis of the stud pin (kg.f).

According to the present invention, the contact between the spring member and the stud pin is not limited to the point contact but can be extended to a surface contact with a predetermined contact area.

If the spring member is substantially in contact with the stud pin at three positions, inclination angle $\theta$ (degrees) of the tapered portion of the stud pin satisfies the following inequality:

$$\theta \geqq 16 \text{ degrees}$$

This value of $\theta$ is significantly larger than conventional value $\theta$ of (=12 degrees).

If inclination angle $\theta$ is increased, the spring member tends to be removed from the stud pin. In order to prevent this, the tapered portion of the stud pin can be constituted by an engagement portion for engaging the spring member and an extended portion extending from the engagement portion. In this case, an angle formed by the central axis of the stud pin and an imaginary line connecting the engagement portion contacting the spring member and the distal end of the extended portion is set to be smaller than the inclination angle of the engagement portion contacting the spring member with respect to the central axis of the stud pin. If an inclination has the same direction as that of the inclination of the engagement portion, the inclination angle of the extended portion must be smaller than that of the engagement portion. However, if the direction of inclination is opposite to that of the lock portion, the inclination angle of the extended portion need not be smaller than that of the lock portion. The surface of the extended portion may be parallel to the axis of the stud pin.

As described above, if the relationship between force F acting along the axial direction of the stud pin and force N acting in a direction substantially perpendicular to the engagement portion of the stud pin satisfies inequality $N/F \leqq 1.8$, damage to the surface of the stud pin upon reception of the impact and vibrations can be reduced so that friction between the stud pin and the spring member can be reduced to prevent the spring member from being fixed at an undesired position. Therefore, the spring member can be fixed at the predetermined fitting position. According to the present invention, the spring member does not excessively engage with the stud pin and can be easily attached thereto or detached therefrom. Even if the attachment/detachment operation is repeated, the position of the spring member is stably fixed so that good beam landing can be achieved. Furthermore, even if external impact acts on the shadow mask, it cannot be easily removed from the stud pin, thereby providing a color picture tube with a good anti-impact property.

DETAILED DESCRIPTION OF THE PREFERRED EMBODIMENTS

A color picture tube according to an embodiment of the present invention will be described with reference to the accompanying drawings.

Figure 1:
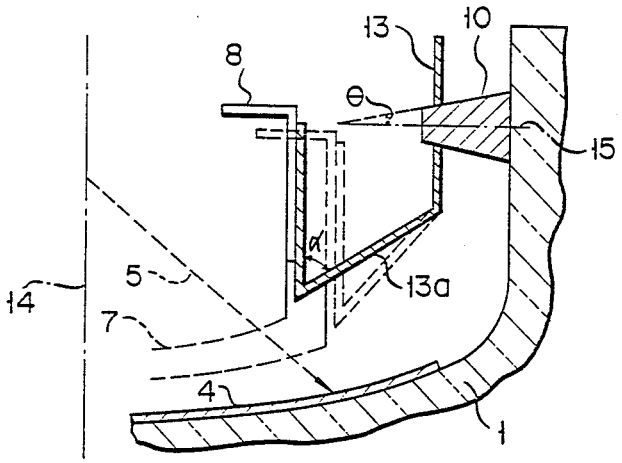
FIG. 1 (PRIOR ART)
FIG. 1 is a sectional view showing a supporting assembly for a shadow mask in a conventional color picture tube.
Figure 2:
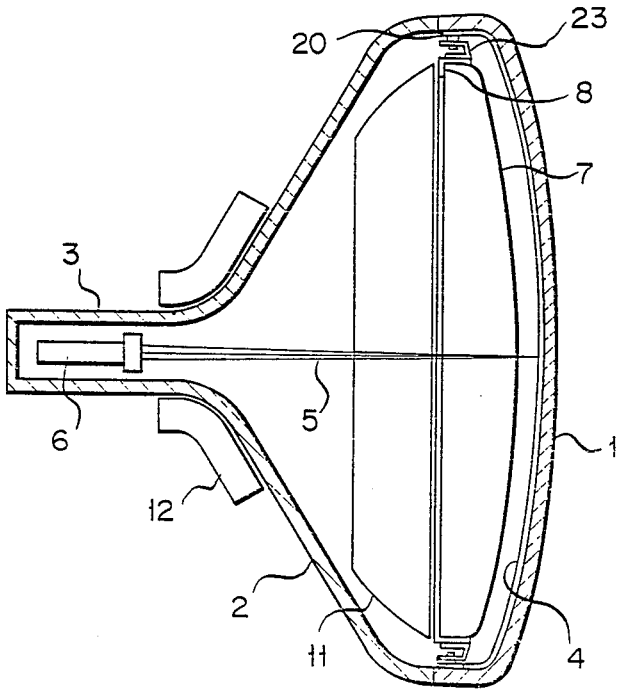
FIG. 2 is a sectional view of a color picture tube according to the present invention.

FIG. 2 is a sectional view of a color picture tube according to the present invention. The color picture tube comprises a vacuum envelope consisting of substantially rectangular panel 1, funnel 2, and neck 3. Phosphor screen 4 consisting of red, green, and blue phosphor layer stripes is formed on the inner surface of panel 1. So-called in line type electron gun assembly 6 is arranged in line in neck 3 along the horizontal axis of panel 1 to generate three electron beams 5 corresponding to red, green, and blue phosphor elements. Shadow mask 7 having a large number of vertical slits arranged in a matrix form is fixed and supported by mask frame 8 at a position opposite and adjacent to screen 4. Mask frame 8 is locked and supported by stud pin 20 embedded in the inner side wall of panel 1 through spring member 23.

Three parallel beams 5 are deflected by deflection yoke 12 surrounding funnel 2 to scan a rectangular area corresponding to panel 1. Beams 5 pass through the corresponding apertures of mask 7 and land on the phosphor screen layer stripes to reproduce a color image. The electron beams are often influenced by an external magnetic field such as geomagnetism and does not often land accurately on the phosphor layer stripes. In order to prevent the color purity of the reproduced image from degrading due to beam mislanding, magnetic shielding plate 11 is locked inside funnel 2 through frame 8.

Figure 3:
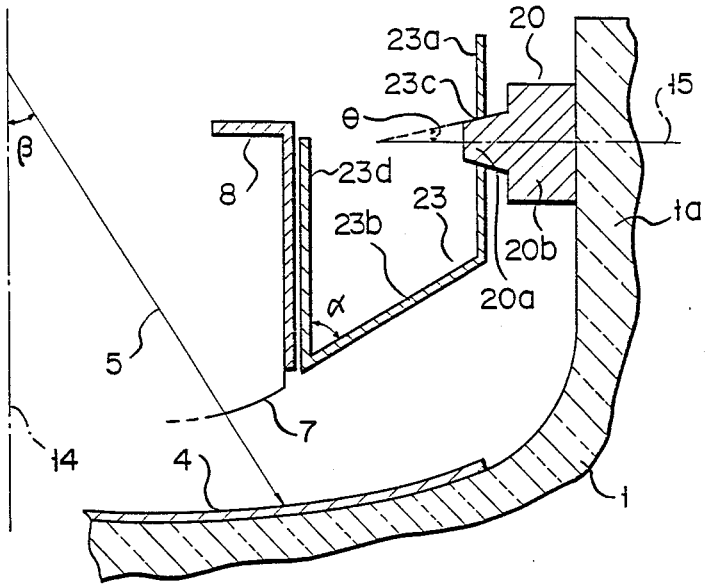
FIG. 3 is a sectional view showing a supporting assembly for a shadow mask according to an embodiment of the present invention.

The embodiment of the present invention will be described in more detail with reference to the enlarged view showing the main part in FIG. 3. Shadow mask 7 is made of a cold-rolled steel plate containing iron as a major constituent and having a thickness of about 0.2 mm. The peripheral edge of the shadow mask is fixed to mask frame 8 made of a cold-rolled steel plate containing iron as a major constituent and having a thickness of about 1.6 mm. Stud pin 20 extends on vertical side portion 1*a* near the corner of rectangular panel 1. Spring member 23 is arranged between frame 8 and pin 20. Spring member 23 is made of a precipitation hardened stainless steel such as SUS631 and has hole 23*c* fitted with pin 20. Spring member 23 comprises supporting portion 23*a* fitted with pin 20 to be parallel to tube axis 14, movable portion 23*b* extending at the side of phosphor screen 4 so as to form angle $\alpha$ between supporting portion 23*a* and axis 14 to be 55 degrees, and fixing portion 23*d* extending from movable portion 23*b* substantially parallel to supporting portion 23*a* and fixed to mask frame 8.

Figure 4A:
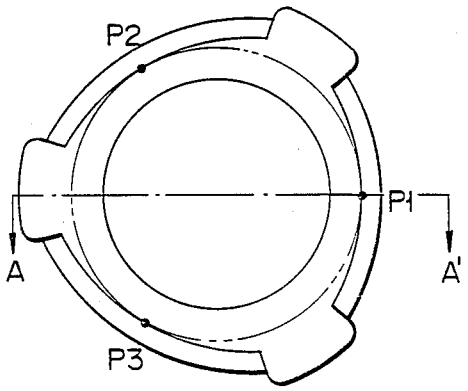
FIG. 4A is a front view showing a fitting state between the spring member and the stud pin in the embodiment of the present invention.
Figure 4B:
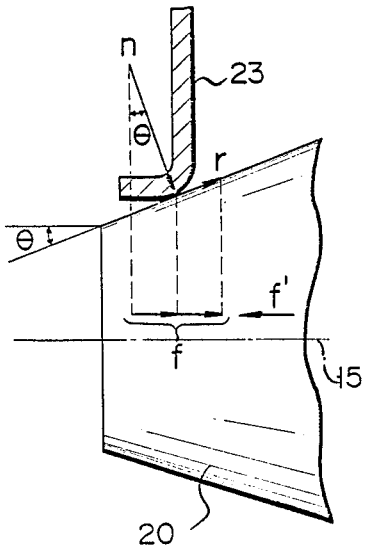
FIG. 4B is a sectional view on line A–A′ of FIG. 4A.

Stud pin 20 is made of an 18% Cr-Fe alloy and comprises truncated cone-shaped engagement portion 20*a* for locking spring member 23 and base portion 20*b* one end of which is embedded in the interior of the panel. Engagement portion 20*a* constitutes a tapered portion having inclination angle $\theta$ with respect to central axis 15 of pin 20. Spring member 23 contacts pin 20 at points (P1, P2, and P3), as shown in FIG. 4A. These points are urged by the spring force of Spring member 23 itself with force f toward pin 20, as shown in FIG. 4B. In this case, drag force n of each point along a direction perpendicular to that surface of the stud pin which is in contact with the spring member and frictional force r of each point along a direction parallel to the surface are effected, and force f' as a reaction force of force f acts from stud pin 20 to spring member 23, thus balancing each other. The relationship between forces f, n, and r is given according to the principle of wedge to be:

$$f=n.\sin\theta+r.\cos\theta=f' \quad (1)$$

Frictional force r is given by static friction coefficient $\mu$ or static frictional angle $\lambda$ as follows:

$$r=\mu n=n.\tan\lambda \quad (2)$$

According to the results of a test made by the present inventors, it is found that static frictional angle $\lambda$ of different metals constituting the stud pin and the elastic material is substantially equal to angle $\theta$ of stud pin 20. Therefore, substitution of equation (2) and $\lambda=\theta$ into equation (1) yields the following equations:

$$f = 2 \cdot n \cdot \sin\theta = 1/3 \cdot F \quad (3)$$

$$N = F/2 \cdot \sin\theta$$

$$\text{because } N = 3n$$

In this case, force F (kg.f) acting along central axis 15 of pin 20 and force N (kg.f) acting in a direction perpendicular to the contact surface of pin 20 satisfy the following inequality:

$$N/F \leqq 1.8$$

In other words, if the spring member contacts the stud pin at three points, drag force n at each point is set as follows:

$$n \leqq 0.6F$$

In a 28" color picture tube having a deflection angle of 110 degrees, mislanding distances of electron beams caused by mechanical impacts are experimentally measured. The direction of impact is perpendicular to the tube axis and the longitudinal direction of the phosphor stripes so as to typically cause mislanding. In other words, an impact acts in a direction parallel to the long sides of the rectangular panel. The magnitude of the impact is represented by an impact acceleration. More specifically, the impact acceleration was 40 $Gm/sec^2$ slightly larger than a value used in transportation or use of the color picture tube.

Figure 5:
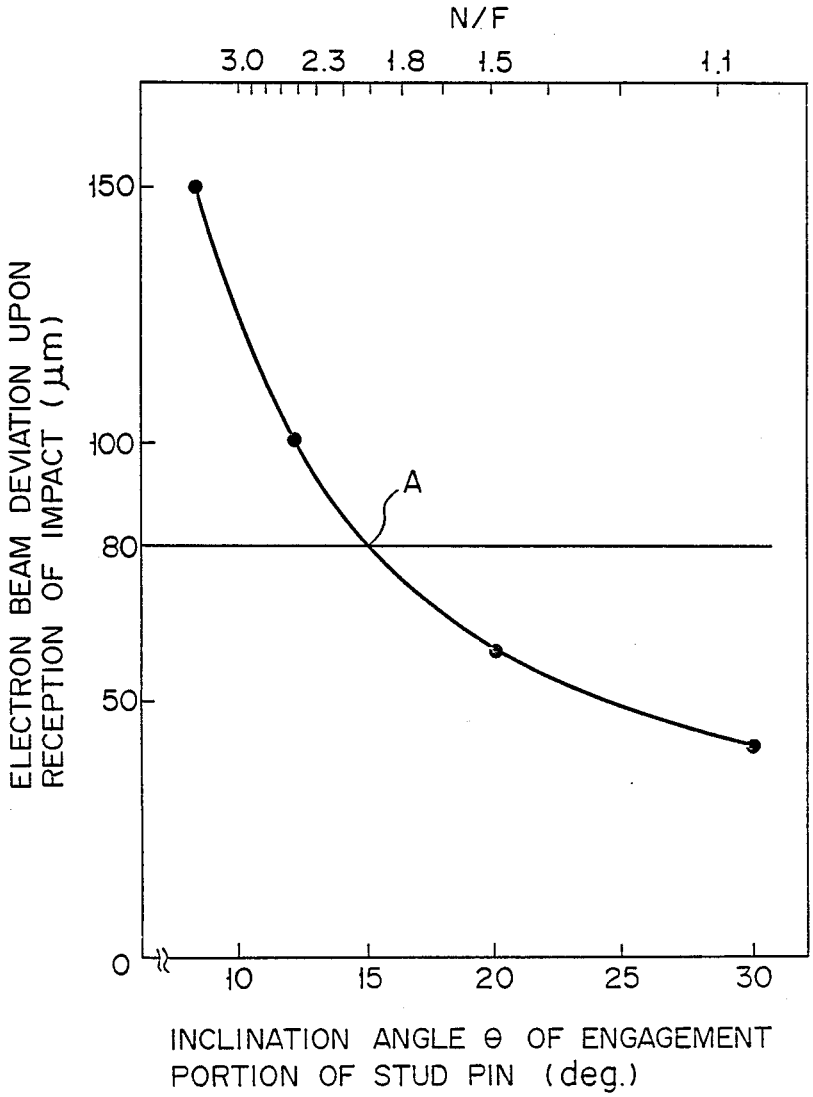
FIG. 5 is a graph showing the relationship between inclination angle $\theta$ of an engagement portion of the stud pin in the embodiment and the displacement of the electron beam when the color picture tube receives impact.

The impact test results are shown in FIG. 5. Ratio N/F of force F acting on inclination angle $\theta$ of the engagement portion of the stud pin and the central axis of the stud pin to force N acting in a direction perpendicular to the contact surface of the stud pin is plotted along the abscissa. The electron beam displacement (a maximum value at the center of the screen) upon application of impact on the color picture tube is plotted along the ordinate. The electron beam displacement upon reception of the impact by the color picture tube was found to be closely associated with inclination angle $\theta$ of the engagement portion of the stud pin, i.e., the force acting along the central axis of the stud pin and the force acting along a direction perpendicular to the contact surface of the stud pin. More specifically, when inclination angle $\theta$ of the engagement portion of the stud pin is increased, ratio N/F is reduced. Since force N acting in a direction perpendicular to the surface of the stud pin is reduced, the degree of damage to the surface of the stud pin can be reduced. Furthermore, since force N acting in the direction perpendicular to the surface of the stud pin is reduced, a frictional force between the stud pin and the spring member is reduced accordingly. Therefore, if force N acting along the direction perpendicular to the surface of the stud pin is reduced, damage to the stud pin can be reduced. Thus, the possibility for allowing fitting at a primary fitting point different from the predetermined fitting point, i.e., a quasi-stable point causing the displacement or deviation of the electron beams can be reduced. At the same time, the frictional force between the stud pin and the spring member can also be reduced. A probability for returning the spring member fitted with the stud pin at the primary fitting point to the predetermined fitting point (i.e., the stable point) is increased, thereby suppressing electron beam mislanding caused by impact.

Figure 6:
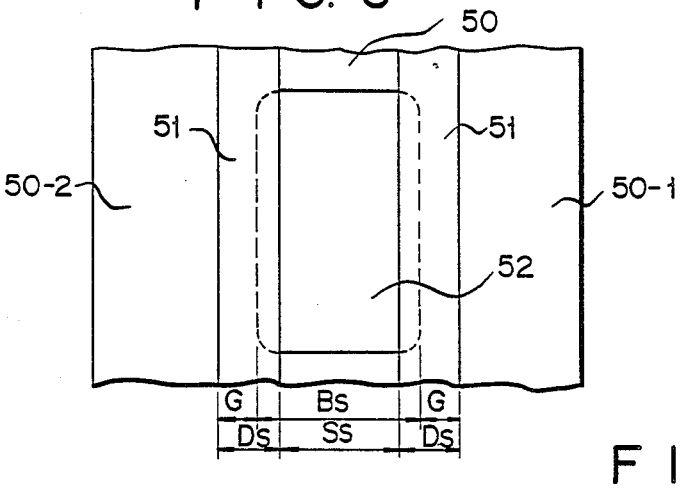
FIG. 6 is a schematic view showing the phosphor stripe and the electron beam.

The allowance of a practical electron beam displacement upon reception of an impact was then considered. In general, the phosphor screen has stripe-shaped phosphor layer 50 having width Ss and light-absorbing areas 51 made of graphite and having a width of Ds each, as shown in FIG. 6. Electron beam spot 52 having width Bs is incident on layer 50 to cross adjacent areas 51, thereby generating light with a specific color. Even if the bombardment position of spot 51 is changed, no color purity degradation occurs unless the beam spot energizes phosphor layer 50-1 or 51-2. A distance between the adjacent phosphor layers (e.g., from the green phosphor layer to the adjacent green phosphor layer) at the center of the screen in the currently used color picture tube is a maximum of about 810 $\mu$m. In this case, width Bs of the electron beam spot is about 210 $\mu$m, width Ss of the phosphor layer is about 170 $\mu$m, and width Ds of the light-absorbing member is about 100 $\mu$m. Therefore, gap G between phosphor layers 50-1 and 50-2 which provides a margin for preventing electron beam spot 52 from energizing a wrong phosphor layer is about 80 $\mu$m since $G=Ds-\{(Bs-Ss)/2\}$. This value can be regarded as a maximum margin at the center of the screen in the color picture tube. In a color picture tube having small outer dimensions or having a small phosphor layer gap, gap or allowance G is reduced accordingly. If the displacement exceeds 80 $\mu$m, color purity is degraded to fail to maintain quality as the color picture tube. This may be confirmed referring to the test results of the present inventors, as shown in FIG. 5. Inclination angle $\theta$ of the engagement portion of the stud pin at point A where the electron beam displacement is 80 $\mu$m is about 15.2 degrees. Ratio N/F is about 1.91. When the spring member is in contact with the stud pin at substantially three positions, the electron beam displacement is 80 $\mu$m or less if pin inclination angle $\theta$ is 16 degrees or more, thus allowing practical applications. In this case, N/F is 1.81, and an effective N/F value can be 1.80 or less. In this case, the spring member is in contact with the pin at three points, and ratio n/F of drag force n to F at each contact point is $n/F \leqq 0.6$. If the spring member is in contact with the stud pin at substantially four positions, the relationship between force F acting along the central axis of the stud pin and force n acting along the direction perpendicular to the surface at each contact point is given as follows:

$$n=F/8 \sin \theta \quad (2)$$

In this case, in order to set n/F to be 0.6, $\theta$ is 12 degrees. In other words, a pin can have the same inclination angle as that of the conventional pin. However, it is very difficult to fit the spring member on the stud pin at substantially four points. In order to obtain the effect of the present invention, instead of increasing the number of contact locations between the spring member and the stud pin, inclination angle $\theta$ of the engagement portion of the stud pin is desirably increased.

According to the present invention, the electron beam displacement upon reception of the impact can be prevented without increasing the spring force of the spring member. The shadow mask can be manually attached to or detached from the panel without difficulty, thus allowing easy manufacture of the supporting assembly in a mass production line.

Figure 7:
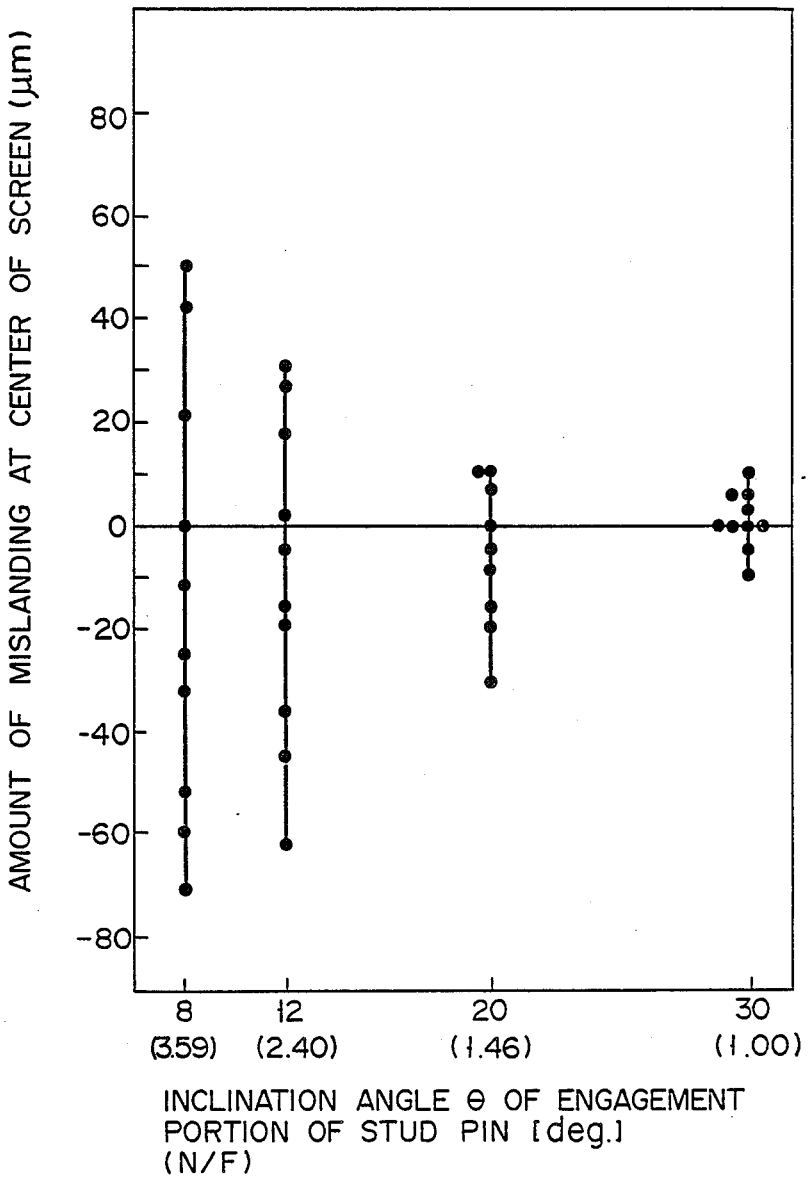
FIG. 7 is a graph showing the mislanding distance of the electron beam of the center of the screen when the inclination angle of the engagement portion of the stud pin is variously changed.

In order to confirm the effect of the present invention, the present inventors made the following test. As soon as the color picture tube is fabricated, i.e., the color picture tube is evacuated and sealed at a high vacuum, and an antiexplosion treatment is performed. An error (i.e., mislanding distance) between the electron beam and the phosphor screen in the center of the screen was measured. The test results are shown in FIG. 7. Referring to FIG. 7, the mislanding distance in the center of the screen is plotted along the cordinate. One black point corresponds to each color picture tube. Inclination angle $\theta$ of the engagement portion of the stud pin is plotted along the abscissa (a free scale is used). Values in parentheses are ratios N/F. As is apparent from FIG. 7, if a conventional pin is used, i.e., if inclination angle $\theta$ is 8 degrees (smaller than 12 degrees), the mislanding distance at the center of the screen greatly varies. However, if inclination angle $\theta$ is increased to 20 and 30 degrees, i.e., if force N acting along the direction perpendicular to the surface of the stud pin is reduced, the mislanding distance is found to be reduced. In the same manner as an increase in inclination angle $\theta$ of the engagement portion of the stud pin causes a decrease in electron beam mislanding distance upon reception of the impact by the color picture tube, when force N acting in the direction perpendicular to the surface of the stud pin is reduced, reproducibility of fitting between the stud pin and the spring member can be found to be improved.

Figure 8:
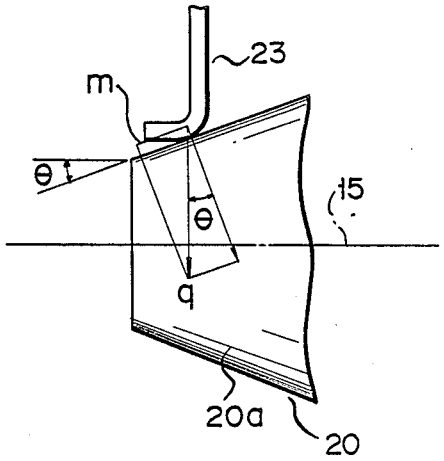
FIG. 8 is a schematic view for explaining force m acting on the spring member so as to remove it from the stud pin.

As shown in the embodiment of the present invention, when inclination angle $\theta$ of the engagement portion of the stud pin is increased, the above-mentioned effect can be expected. As shown in FIG. 8, if force q acts in the direction of the axis of the color picture tube, i.e., in a direction perpendicular to central axis 15 of stud pin 20, force m represented by the following equation acts to remove spring member 23 from stud pin 20. The relationship between forces m and q is given as follows:

$$m=q.\sin \theta \quad (3)$$

Figure 9:
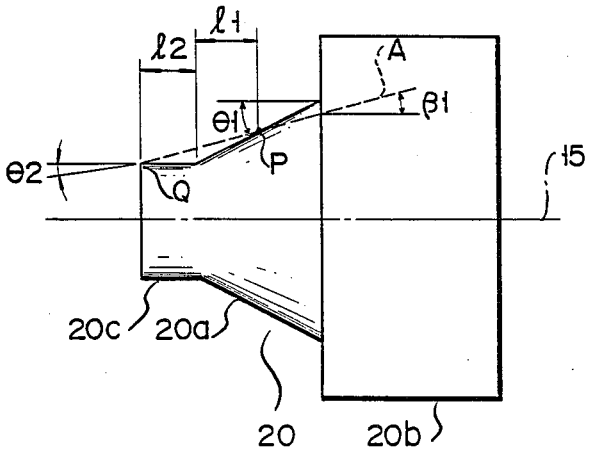
FIG. 9 is a sectional view showing a stud pin according to another embodiment of the present invention.

If inclination angle $\theta$ of the stud pin is increased, the anti-impact property can be improved. However, the possibility of accidental removal of the spring member from the stud pin can be increased depending upon a given impact direction. However, this problem can be solved, as shown in FIG. 9. Distal end portion 20c having inclined angle $\theta_2$ with respect to the central axis of the pin is formed at the distal end of stud pin 20 having engagement portion 20a having inclination angle $\theta_1$. If angles $\theta_1$ and $\theta_2$ satisfy the following condition, the spring member will not be removed from the stud pin:

$$\theta_1>\theta_2 \quad (4)$$

Referring to FIG. 9, the stud pin comprises base portion 20b embedded in the inner surface wall of a panel (not shown), conical engagement portion 20a continuous with base portion 20b and engaged with the spring member, and portion 20c extending from engagement portion 20a in a direction opposite to the panel. Angle $\theta_1$ between the stud pin and a spring member (not shown) of engagement portion 20a near contact portion P is larger than angle $\beta_1$ (to be referred to as an imaginary line inclination angle hereinafter) formed by an imaginary line (indicated by broken line A) connecting contact portion P and distal end portion Q of extended portion 20c. Distal end portion Q is the extreme end when extended portion 20c is viewed from contact portion P of engagement portion 20a. In this manner, extended portion 20c extends from engagement portion 20a at an inclination angle different from that of engagement portion 20a, and imaginary line inclination angle $\beta_1$ is smaller than inclination angle $\theta_1$. Even if an external impact acts on the spring member, it will not be removed from the stud pin. If angle $\theta_1$ of engagement portion is equal to angle $\beta_1$, engagement and extended portions 20a and 20c have substantially the same inclination angle. In this case, engagement portion 20a cannot be distinguished from extended portion 20c, thus obtaining the same arrangement as in FIG. 3.

If imaginary line inclination angle $\beta_1$ is 0, i.e., if imaginary line A is parallel to central axis 15 of the stud pin, the diameter of the stud pin at contact portion P of engagement portion 20a having the same opening diameter as in the spring member is the same as the diameter of the stud pin at distal end portion Q of extended portion 20c. If the diameter of Q is larger than that of P, the distal end of the stud pin is not inserted in the opening of the spring member, so the spring member is not engaged by the stud pin. Therefore, $\beta_1$ must not be 0 or less, i.e., imaginary line A must not be an inclined surface opposite to the inclined surface of the engagement portion.

Inclination angles $\theta_1$ and $\theta_2$ will be described in more detail. Although conventional inclination angle $\theta_1$ is 12 degrees, it is increased to 24 degrees in this embodiment. Inclination angle $\theta_2$ is 5 degrees. Length $l_2$ between the distal end of extended portion 20c and the boundary between extended and engagement portions 20c and 20a is 0.7 mm. Length $l_1$ between the boundary to contact portion P between the spring member and engagement portion 20a is 0.5 mm. In this case, since $\theta 1$ is 24 degrees, then N=1.23F, thus decreasing N to about ½ for $\theta 1$=12 degrees (N=2.40F). More specifically, as described above, when the spring member urges the stud pin along the axial direction, the force acting on the stud pin can be greatly decreased as compared with the conventional case. For this reason, the spring member can be easily removed from the stud pin. In addition, excessive extending of the spring member into the stud pin can be prevented.

If a large external impact causes force q (FIG. 8) to act on stud pin axis 15 along a direction perpendicular thereto, the spring member is slid along engagement portion 20a. When the spring member reaches extended portion 20c, sliding force m given by inequality (2) becomes very small since inclination angle $\theta_2$ is very small, so that the spring member stops at engagement portion 20c. Therefore, the spring member is not removed from the stud pin. After the impact is eliminated, the spring member returns to the accurate engagement position by the spring force.

Figure 10:
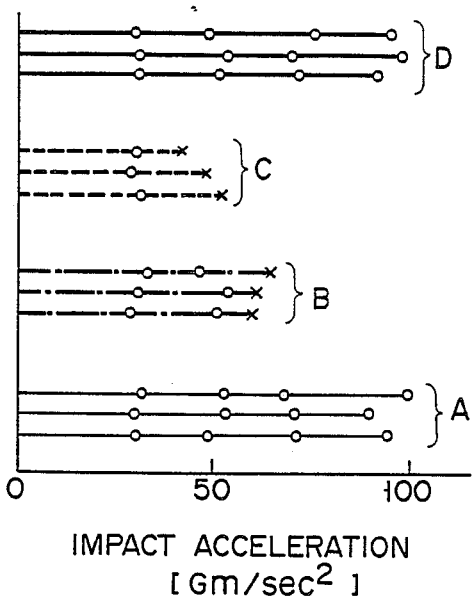
FIG. 10 is a chart of test results showing deviations of the spring member from the stud pin when an impact acts on the color picture tube.

FIG. 10 shows the test results showing a magnitude of impact acting on the stud pin to remove the spring member from the stud pin when an axial impact acts in a 28" shadow mask type color picture tube having a deflection angle of 110 degrees. The abscissa in FIG. 10 represents an impact acceleration Gm/sec$^2$. This graph shows data A to data D. Data A represents the case wherein anlge $\theta_1$ of the engagement portion of the stud pin is conventional 12 degrees. Data B represents the case wherein angle $\theta_1$ is 17 degrees. Data C represents the case wherein angle $\theta_1$ for a conventional stud pin is 20 degrees. Data D represents the case of the stud pin in FIG. 9, i.e., $\theta_1=24$ degrees and angle $\theta_2=5$ degrees. Referring to FIG. 10, each circle indicates that the shadow mask is not removed from the stud pin even if an impact acts thereon, and each cross indicates that the shadow mask is removed therefrom. As is apparent from FIG. 10, if angle $\theta_1$ of the engagement portion of the stud pin is increased, the shadow mask can be easily removed. However, if an extended portion having inclination angle $\theta_2$ smaller than $\theta_1$ of the engagement portion is formed as in FIG. 9, the shadow mask will not be easily removed from the stud pin.

Figure 11:
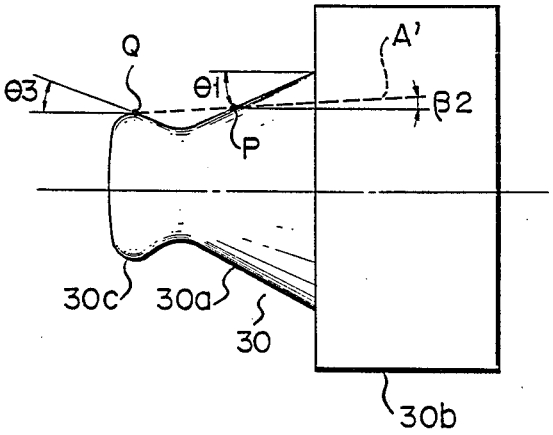
FIG. 11 is a sectional view showing a stud pin according to still another embodiment of the present invention.

FIG. 11 shows another embodiment of the present invention. Base portion 30b and engagement portion 30a are the same as those in the previous embodiment (FIG. 9). However, extended portion 30c is inclined in the opposite direction to engagement portion 30a. In other words, the distal end portion of extended portion 30c is flared from engagement portion 30a with respect to pin axis 15 to form inclination angle $\theta_3$. In this case, inclination angle $\beta_2$ between distal end Q of extended portion 30c and imaginary line A' connecting distal end Q and contact portion P of an spring member (not shown) of engagement portion 30a is smaller than angle $\theta_1$ in the same manner as in the previous embodiment. In this embodiment, even if the spring member is slid along engagement portion 30a by an external impact, it is stopped by extended portion 30c so the spring member is not removed from the stud pin. In the embodiment of FIG. 11, the boundary between engagement portion 30a and extended portion 30c may be parallel to axis 15 or may be constituted by a surface with a gradually changing inclination angle. Alternatively, the boundary may be constituted by a surface whose inclination angle is changed sharply. Angle $\theta_3$ need not be smaller than $\theta_1$. It is thus essential to satisfy relation $0 \leqq \beta_2 < \theta_1$.

The cases in FIGS. 9 and 11 indicate the following facts. If the inclination parallel to axis 15 of the stud pin is given 0, an inclination having the same direction as that of the engagement portion is given as +, and an inclination having a direction opposite that of the engagement portion is given as −, the inclination angle of the extended portion may be +, −, or 0. The stud pins are manufactured in a mass production line in practice. For this reason, the inclination angle of the extended portion is preferably + rather than 0. However, if the inclination angle is defined as 0 or −, removal of the shadow mask (spring member) can be more effectively prevented, and stud pins therefor can be easily machined.

As in the above embodiments, when a shadow mask is suspended at four corners of a rectangular panel, rigidity of the mask frame as a supporting frame is improved. Therefore, the mask frame can be made thinner. For example, if the thickness of the mask frame is set to be 0.5 mm, the overall weight can be reduced by about 70%, as compared with a 28" color picture tube of each of the above embodiments. A 1.6-mm thick conventional mask frame has an overall weight of about 1.6 kg, but a 0.5-mm thick mask frame can be as light as about 0.5 km. The lightweight implementation can restrict the beam displacement when an impact acts on the color picture tube.

Figure 12:
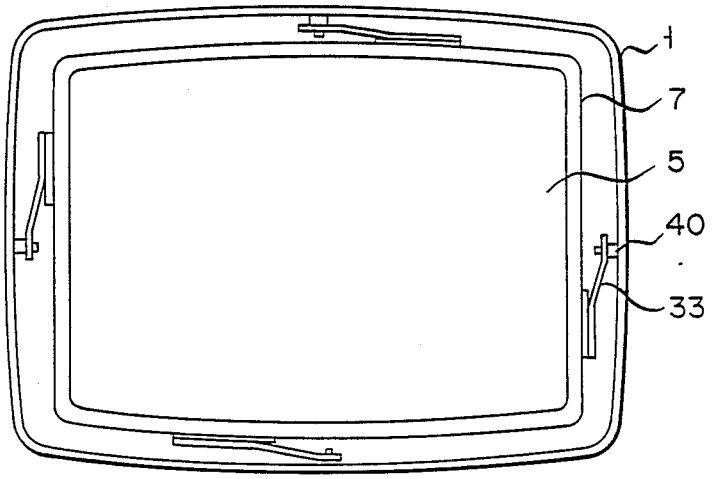
FIG. 12 is a schematic view showing the mounting positions between the panel and the shadow mask.

The above embodiments are exemplified by color picture tubes each suspending a shadow mask at four corners of the rectangular panel. However, the present invention is not limited to this arrangement. For example, as shown in FIG. 12, shadow mask 5 may be suspended at substantially centers of the long and short sides of rectangular panel 1, or shadow mask 5 can be suspended through spring member 33 fitted on stud pin 40, thereby obtaining a desired effect.

What is claimed is:

1. A color picture tube comprising a panel of a substantially rectangular shape, a phosphor screen formed on the inner surface of said panel, a stud pin having a tapered portion and mounted on an inner side of said panel, a spring member having a through hole and fitted with said tapered portion of said stud pin through said through hole, and a shadow mask mounted on said panel through said stud pin and said spring member so as to be opposite or adjacent to said phosphor screen, wherein said stud pin comprises an engagement portion for locking said spring member, said engagement portion having a part which contacts the spring member, and an extended portion contiguous with said engagement portion and extended in a direction opposite to said panel, a first inclination angle formed between the central axis of said stud pin and an imaginary line, said imaginary line connecting said part of said engagement portion which contacts said spring member and a distal end of said extended portion, said first inclination angle being smaller than an inclination angle between the central axis of said stud pin and said tapered portion; and wherein said spring member is in contact with said stud pin at three points, and an angle between said central axis of said stud pin and the surface of said tapered portion of said stud pin is not less than 16 degrees.

2. A tube according to claim 1, wherein a diameter of a distal end of said extended portion is smaller than a diameter of a distal end of said engagement portion, and an inclination angle of said extended portion is smaller than that of said engagement portion.

3. A tube according to claim 1, wherein a diameter of a distal end of said extended portion is larger than a diameter of a distal end of said engagement portion and is not larger than part of said engagement portion which is in contact with a spring member.

4. A tube according to claim 1, wherein said stud pin is fixed to a region proximate to a corner of said panel.

5. A tube according to claim 1, wherein said stud pin is fixed at centers of four sides of said panel.

6. A tube according to claim 1, wherein the Vickers hardness of said stud pin is lower than that of said spring member.

* * * * *